US006978574B1

(12) United States Patent
Valenta

(10) Patent No.: US 6,978,574 B1
(45) Date of Patent: Dec. 27, 2005

(54) FLOWER BOUQUET SUPPORT

(76) Inventor: Tina M. Valenta, P.O. Box 1993, Seguin, TX (US) 78155

( * ) Notice: Subject to any disclaimer, the term of this patent is extended or adjusted under 35 U.S.C. 154(b) by 0 days.

(21) Appl. No.: 11/083,325

(22) Filed: Mar. 18, 2005

(51) Int. Cl.[7] ..... A01G 5/00
(52) U.S. Cl. ..... 47/41.11
(58) Field of Search ..... 47/41.01, 41.11, 47/41.13, 41.1

(56) References Cited

U.S. PATENT DOCUMENTS

| | | | | |
|---|---|---|---|---|
| 180,613 A | | 8/1876 | McCutchins | |
| 551,000 A | | 12/1895 | Parker | |
| 1,402,904 A | | 1/1922 | Skidmore | |
| 1,762,843 A | | 6/1930 | Straub | |
| 1,970,602 A | * | 8/1934 | Geistlinger | 248/103 |
| 2,064,696 A | * | 12/1936 | Smith et al. | 43/55 |
| 2,067,016 A | * | 1/1937 | Packer | 248/213.2 |
| 2,381,253 A | * | 8/1945 | Bierwert | 47/41.11 |
| 2,508,947 A | * | 5/1950 | Hoke | 248/300 |
| 2,671,624 A | | 3/1954 | Carney | |
| 3,065,947 A | * | 11/1962 | Thompson | 248/508 |
| 3,250,504 A | | 5/1966 | Schwaderlapp | |
| 4,387,873 A | * | 6/1983 | Pavlo et al. | 248/227.1 |
| 5,249,772 A | | 10/1993 | Montie, Jr. et al. | |

FOREIGN PATENT DOCUMENTS

| | | |
|---|---|---|
| DE | 4007922 | 9/1991 |

* cited by examiner

*Primary Examiner*—Francis T. Palo
(74) *Attorney, Agent, or Firm*—Stephen R. Greiner

(57) ABSTRACT

A flower bouquet support including a hanger adapted for suspension from the side wall of a vase. A thumbscrew is threadably secured to the top of the hanger to releasably secure the hanger upon the side wall of the vase. At least one retaining strap is secured to the bottom of the hanger so as to grasp the stems of a flower bouquet positioned adjacent the hanger.

6 Claims, 2 Drawing Sheets

FLOWER BOUQUET SUPPORT

FIELD OF THE INVENTION

The present invention relates generally to plant husbandry and, more particularly, to flower holders.

BACKGROUND OF THE INVENTION

It has become customary to decorate the graves of deceased individuals with artificial flowers. Such flowers closely mimic their natural counterparts in appearance but are slow to decay. In fact, artificial flowers are virtually impervious to weathering and can have useful lives of many months. Thus, it should not be necessary to frequently change artificial flower arrangements decorating graves.

Cemetery operators have come to learn of a drawback possessed by artificial flowers, namely they are much lighter than real flowers. A moderate breeze is all that is required to lift a bouquet of artificial flowers from a vase placed at a grave and send the bouquet tumbling toward the nearest fence. On a windy day, it is not unusual for some cemetery maintenance crews to pick up several dozen bouquets of artificial flowers. Since lost bouquets are not often marked, their owners seldom relocate them. The aggravating purchase of a replacement bouquet is required.

SUMMARY OF THE INVENTION

In light of the problems associated with the wind transporting bouquets of artificial flowers left in cemeteries, it is a principal object of the invention to provide a support for a bouquet of flowers in a vase. The support holds the stems of a loose collection of flowers together in a tight bunch and securely and releasably secures these flowers to a vase. Thus, wind cannot blow away a bouquet secured in a vase by the flower bouquet support.

It is another object of the invention to provide a flower bouquet support of the type described that can be used with both artificial flowers and real flowers.

It is an object of the invention to provide improved elements and arrangements thereof in a flower bouquet support for the purposes described that is lightweight in construction, inexpensive to manufacture, and dependable in use.

Briefly, the bouquet support in accordance with this invention achieves the intended objects by featuring a hanger adapted for suspension from the side wall of a vase. The hanger includes: a hook for receiving the top of the side wall of the vase, a crosspiece that extends laterally from the hook, and a shank that projects downwardly from the crosspiece. A thumbscrew is threadably secured to the hook for releasably securing the hanger upon the side wall of the vase. A pair of retaining straps is secured to the shank in a spaced apart relationship so as to grasp the stems of a flower bouquet being positioned adjacent the shank.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
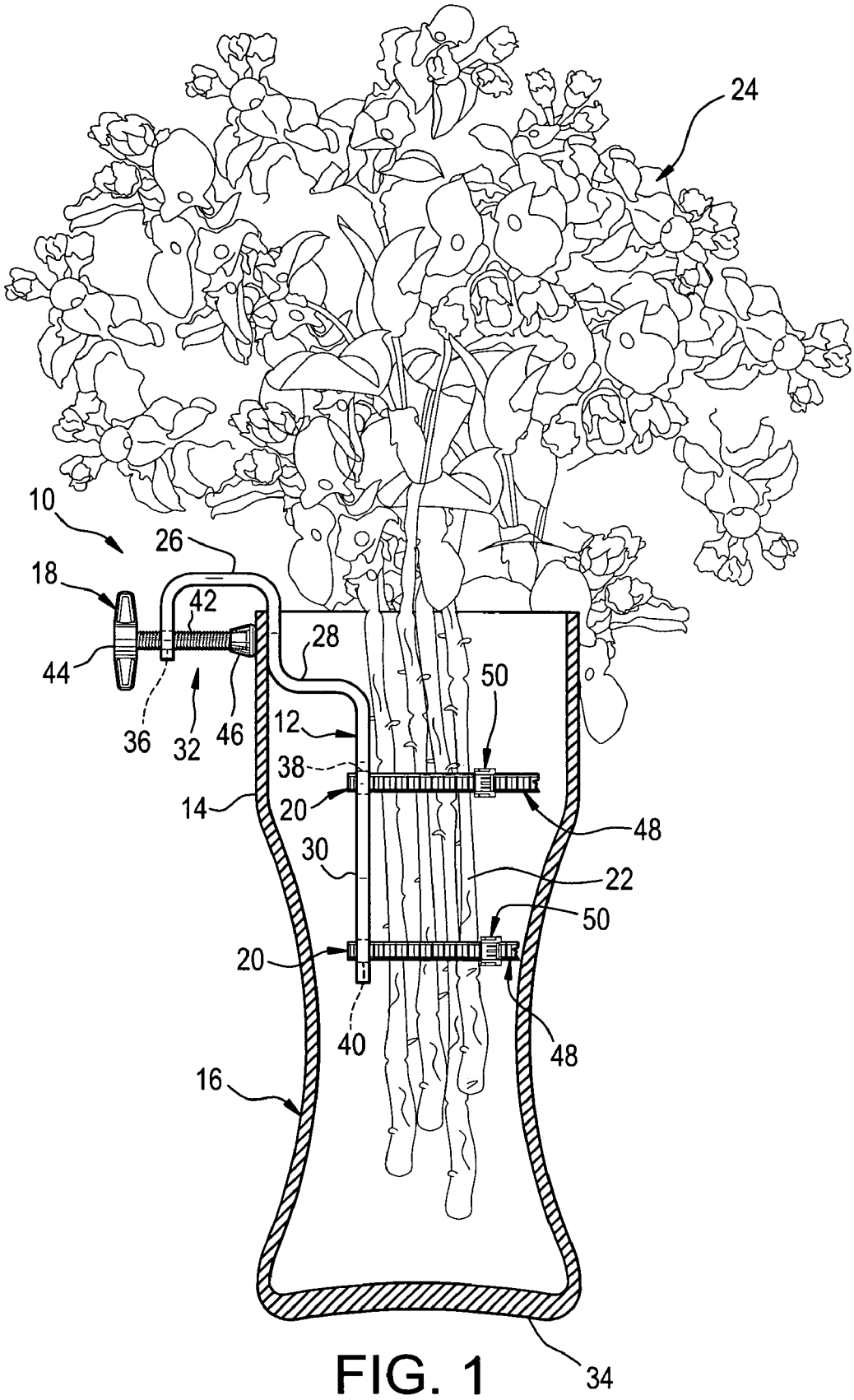
FIG. 1 is a side view of a flower bouquet support in accordance with the present invention shown secured to a flower vase.

Referring now to the FIGS., a flower bouquet support in accordance with the present invention is shown at 10. Support 10 includes a hanger 12 adapted for suspension from the side wall 14 of a vase 16. A thumbscrew 18 is threadably secured to the top of hanger 12 to lock hanger 12 upon side wall 14. A pair of retaining straps 20 is secured to the bottom of the hanger 12 to grasp the stems 22 of a flower bouquet 24 positioned in vase 16.

Hanger 12 has a hook 26 connected by a crosspiece 28 to a shank 30. Hook 26 is configured like an inverted "U" so as to define a recess 32 for receiving the top of side wall 14 of vase 16. Crosspiece 28, however, extends horizontally from the inner end of hook 26 toward the center of vase 16. Shank 30 projects vertically downward from the inner end of crosspiece 28 toward the bottom wall 34 of vase 16.

The dimensions of hook 26, crosspiece 28 and shank 30 are a matter of design choice. Thus, they can be varied to accommodate vases having shapes other than that of vase 16. Nevertheless, hanger 12 should be configured to locate the center of gravity of bouquet 24 as low as possible and as close as possible to the center of the vase that support 10 will be used. Thus, thoughtful dimensioning of hanger 12 can minimize the likelihood of tipping of a vase carrying hanger 12.

Hanger 12 is provided with a number of openings along its length. For example, a threaded aperture 36 penetrates the outer end of hook 26 for the passage of thumbscrew 18. Additionally, two pairs of side-by-side slots 38 and 40 pass through shank 30 and receive retaining straps 20. As shown, slots 38 are located at the top of shank 30 and slots 40 are positioned at the bottom of shank 30 to ensure that straps 20 maintain a wide and stable grip upon flower stems 22.

Thumbscrew 18 includes a threaded shaft 42 threadably engaged with threaded aperture 36. Affixed to the outer end of shaft 42 is a knob 44 that permits a user to rotate threaded shaft 42 in aperture 36 to selectively drive the inner end of shaft 42 toward side wall 14 of vase 16 without resort to additional tools. Also, a resilient rubber sleeve 46 is positioned over the inner end of shaft 42 for snugly engaging side wall 14 of vase 16 and for minimizing the likelihood that shaft 42 will scratch or crack vase 16.

Figure 2:
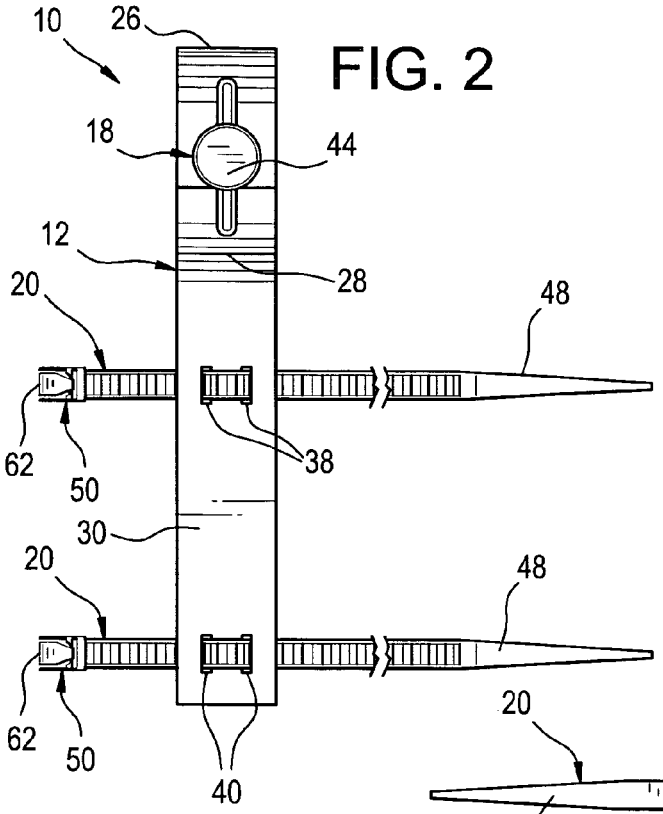
FIG. 2 is a front view of the flower bouquet support of FIG. 1.
Figure 3:
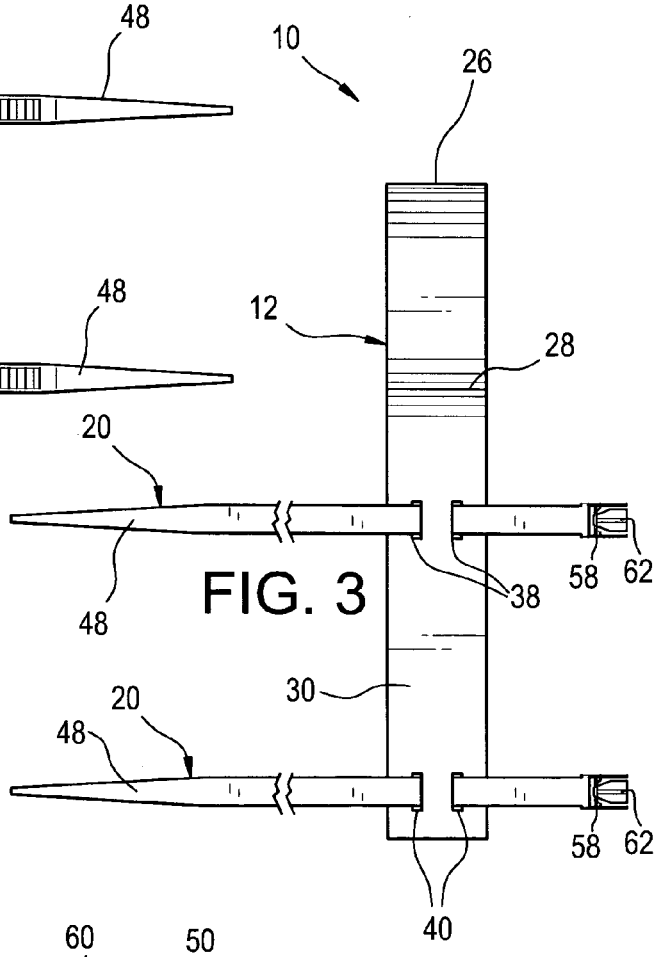
FIG. 3 is a rear view of the flower bouquet support.
Figure 4:
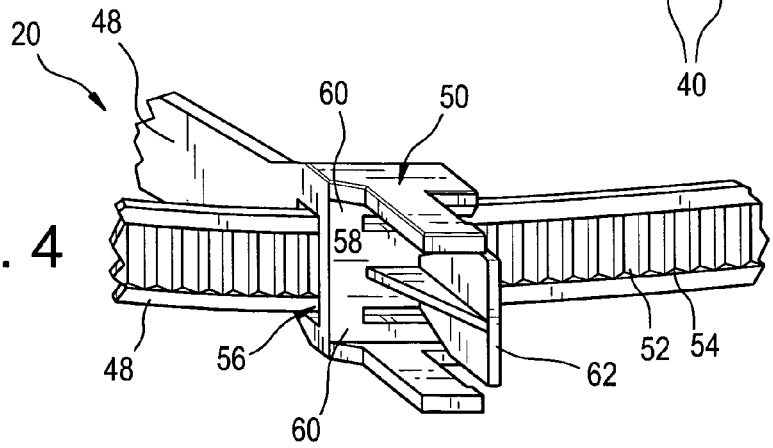
FIG. 4 is an enlarged perspective view of the clasp portion of the retaining strap of the flower bouquet support.

Each of retaining straps 20 has a flexible band 48 to one end of which a clasp 50 is molded. As shown, the front of band 48 is provided with a series of alternating ridges 52 and valleys 54. The free end of band 48 is extended through a passageway 56 in clasp 50. A plate 58 forms the front of passageway 56 and is biased by resilient mounting tabs 60, joining plate 58 to the balance of clasp 50, against the front of band 48. Extending forwardly from the free end of plate 58 is a locking tab 62 whose inner end is adapted for positioning in a valley 54 to fix the diameter of a strap 20 and whose outer end is adapted for manipulation by a user to withdraw the inner end from a valley 54 so that band 48 can be pulled from clasp 50 as illustrated in FIGS. 2 and 3.

Use of support 10 is straightforward. First, straps 20 are adjusted on hanger 12 so that the free ends of bands 48 just pass through clasps 50 to form two large loops. Then, stems 22 of bouquet 24 are gathered into a tight bunch and are inserted into the loops formed in bands 48. Now, bands 48 are pulled to the extent possible through clasps 50 to secure bouquet 24 to hanger 12. At this point, if bouquet 24 comprises fresh flowers, vase 16 is filled with water. Later, hook 26 is positioned over the top of side wall 14 of vase 16 and thumbscrew 18 is tightened to lock support 10 upon vase 16. The entire process requires only a few seconds to complete and provides a virtually endless protection for bouquet 24 from being dislodged from vase 16 by wind and other outside forces.

While flower bouquet support 10 has been described with a high degree of particularity, it will be appreciated by those skilled in the art that modifications can be made to it. Therefore, the present invention is not limited in scope to the support 10 described above, but encompasses any and all supports within the scope of the following claims.

I claim:

1. A flower bouquet support, comprising:
- a hanger being adapted for suspension from the side wall of a vase;
- a thumbscrew being threadably secured to the top of said hanger to releasably secure said hanger upon the side wall of the vase; and,
- a retaining strap being secured to the bottom of said hanger so as to encircle the stems of a flower bouquet being positioned adjacent said hanger.

2. The flower bouquet support according to claim 1 wherein said hanger includes:
- a hook defining a recess for receiving the top of the side wall of the vase;
- a crosspiece extending horizontally from said hook so as to position the stems of a flower bouquet proximate the center of the vase;
- a shank projecting downwardly from said crosspiece and said shank carrying said retaining strap.

3. A flower bouquet support, comprising:
- a hanger being adapted for suspension from the side wall of a vase, said hanger including:
  - a hook for receiving the top of the side wall of the vase;
  - a crosspiece extending sideways from said hook; and,
  - a shank projecting downwardly from said crosspiece;
- a thumbscrew being threadably secured to said hook so as to releasably secure said hanger upon the side wall of the vase; and,
- a retaining strap being secured to said shank so as to encircle the stems of a flower bouquet being positioned adjacent said shank.

4. The flower bouquet support according to claim 3 wherein said thumbscrew includes:
- a threaded shaft being threadably engaged with said hook;
- a knob being affixed to one end of said threaded shaft; and,
- a resilient rubber sleeve being positioned over the other end of said threaded shaft for engaging the side wall of the vase.

5. The flower bouquet support according to claim 3 wherein said retaining strap includes:
- a flexible band having a series of alternating ridges and valleys along the length thereof; and,
- a clasp being affixed to one end of said band, said clasp having a passageway for receiving the free end of said band, said clasp also having a locking tab for selective insertion into one of said valleys for fixing the diameter of said strap.

6. A flower bouquet support, comprising:
- a hanger being adapted for suspension from the side wall of a vase, said hanger including:
  - a hook for receiving the top of the side wall of the vase;
  - a crosspiece extending laterally from said hook; and,
  - a shank projecting downwardly from said crosspiece;
- a thumbscrew being threadably secured to said hook for releasably securing said hanger upon the side wall of the vase; and,
- a pair of retaining straps being secured to said shank in a spaced apart relationship so as to encircle the stems of a flower bouquet being positioned therein.

* * * * *